United States Patent [19]

Mitui et al.

[11] Patent Number: 4,919,097

[45] Date of Patent: Apr. 24, 1990

[54] ENGINE OUTPUT CONTROL SYSTEM

[75] Inventors: Syuzi Mitui, Hiroshima; Kouichirou Waki, Mihara; Yasuhiro Harada, Kure, all of Japan

[73] Assignee: Mazda Motor Corporation, Hiroshima, Japan

[21] Appl. No.: 288,266

[22] Filed: Dec. 22, 1988

[30] Foreign Application Priority Data

Dec. 23, 1987 [JP] Japan ..... 62-326162
Dec. 23, 1987 [JP] Japan ..... 62-326165

[51] Int. Cl.[5] ..... F02D 11/04; F02D 11/10; F02D 41/10

[52] U.S. Cl. ..... 123/399; 123/400; 123/361

[58] Field of Search ..... 123/361, 399, 400; 180/178, 179

[56] References Cited

U.S. PATENT DOCUMENTS 4,424,785 1/1984 Ishida et al. ..... 123/400 X
4,523,565 6/1985 Omitsu ..... 123/399
4,643,148 2/1987 Jedrziewski ..... 123/400 X
4,691,677 9/1987 Hotate et al. ..... 123/399
4,729,356 3/1988 Kaneko et al. ..... 123/399 X

FOREIGN PATENT DOCUMENTS 0122742 7/1984 Japan ..... 123/399

*Primary Examiner*—Willis R. Wolfe
*Attorney, Agent, or Firm*—Fleit, Jacobson, Cohn, Price, Holman & Stern

[57] ABSTRACT

An engine output control system comprising an acceleration detector for detecting an amount of a stroke of accelerator and producing an acceleration signal in accordance with the amount of the stroke, throttle valve, electrical control mechanism for determining an electrical control signal to actuate the throttle valve in accordance with the electrical control signal, mechanical control mechanism mechanically linked with the throttle valve for actuating the same in accordance with the amount of the stroke, abnormality detector for detecting an abnormality of the electrical control mechanism, switch mechanism for producing a signal to switch a control for the throttle valve between the mechanical and the electrical control mechanism, and switching control mechanism for performing an actual switching action from the mechanical control mechanism to the electrical control mechanism based on the signal from the switching mechanism under a specific engine operating condition.

17 Claims, 10 Drawing Sheets

ENGINE OUTPUT CONTROL SYSTEM

BACKGROUND OF THE INVENTION

1. Field of the Invention

The present invention relates to an engine output control system for controlling an engine output in accordance with an amount of acceleration pedal operation, more specifically to an control system provided with both an electrical control mechanism and a mechanical control mechanism which are selectively employed for controlling the engine output.

2. Description of the Prior Art

Japanese Patent Public Disclosure No. 51-138235 laid open to the public in 1976 discloses an engine output control system for controlling an opening of a throttle valve in accordance with an acceleration pedal operation so that the engine output is controlled in response to an engine operating condition.

Japanese Patent Public Disclosure No. 59-12742 laid open to the public in 1984 discloses an engine output control system in which an mechanical control system for mechanically controlling the opening of the throttle valve is actuated to provide a minimum opening of the throttle valve when an electrical control system for electrically controlling the opening of the throttle valve is out of order so that a certain engine output can be obtained. When the electrical control mechanism is restored, the engine output control is switched to the electrical control again.

It should however be noted that a torque shock may be produced when the electrical control is switched to the mechanical control because the electrical control is different from the mechanical control in control property.

Meanwhile, the control system as disclosed in the Japanese Patent Public Disclosure No. 51-12742 is usually provided with a magnetic clutch disposed between a drive motor for the throttle valve and the throttle valve for switching the engine output between the electrical control and the mechanical control wherein the electrical control is exerted when the magnetic clutch is engaged and the mechanical control is exerted when the magnetic clutch is disengaged. It is disadvantageous in that there is a certain delay time before an actual engagement force is produced after the magnetic clutch is turned on. As a result, a slippage is produced in the magnetic clutch in the case where the motor is actuated to move the throttle valve. This means that the delay time in the clutch causes a wear of the clutch and deteriorates a controllability of the throttle valve.

SUMMARY OF THE INVENTION

It is therefore a primary object of the present invention to provide an engine output control system provided with both an electrical control mechanism and a mechanical control mechanism for controlling electrically and mechanically an engine output respectively in which the engine output control is switched between the electrical control and mechanical control smoothly and successfully.

It is another object of the invention to provide an engine output control system which has an improved controllability of the engine output.

It is a further object of the present invention to provide an engine output control system having an electrical control mechanism for electrically controlling an engine output, a mechanical control mechanism for mechanically controlling an engine output and a magnetic clutch for changing the engine output control between the electrical and mechanical controls in which the magnetic clutch is actuated without slippage thereof.

According to the present invention, there is provided an engine output control system comprising an acceleration detecting means for detecting an amount of a stroke of acceleration means and producing an acceleration signal in accordance with the amount of the stroke of the acceleration means, output control means for controlling an engine output, electrical control means for determining an electrical control signal to actuate the output control means in accordance with the electrical control signal, mechanical control means mechanically linked with the output control means for actuating the output control means in accordance with the amount of the stroke of the acceleration means, abnormality detecting means for detecting an abnormality of the electrical control means, switch means for producing a signal to switch a control for the output control means between the mechanical control means and the electrical control means in a manner that the output control means is controlled by the mechanical means when an abnormality is detected by the abnormality detecting means and is controlled by the electrical means when any abnormality is not detected by the abnormality, and switching control means for performing an actual switching action from the mechanical control means to the electrical control means based on the signal from the switch means under a specific engine operating condition.

In preferred embodiment, the switching control means reduces a control gain of the electrical control means for the output control means under a predetermined engine operating condition so that the control of the output control means by the electrical means is substantially restrained. Alternatively, the switching control means controls a timing of an actual restoration of the electrical means after the switching control means received signals that the abnormality is no longer detected.

The above and other features of the present invention will be apparent from the following description taking reference with the accompanying drawings.

DESCRIPTION OF THE PREFERRED EMBODIMENTS

Figure 1:
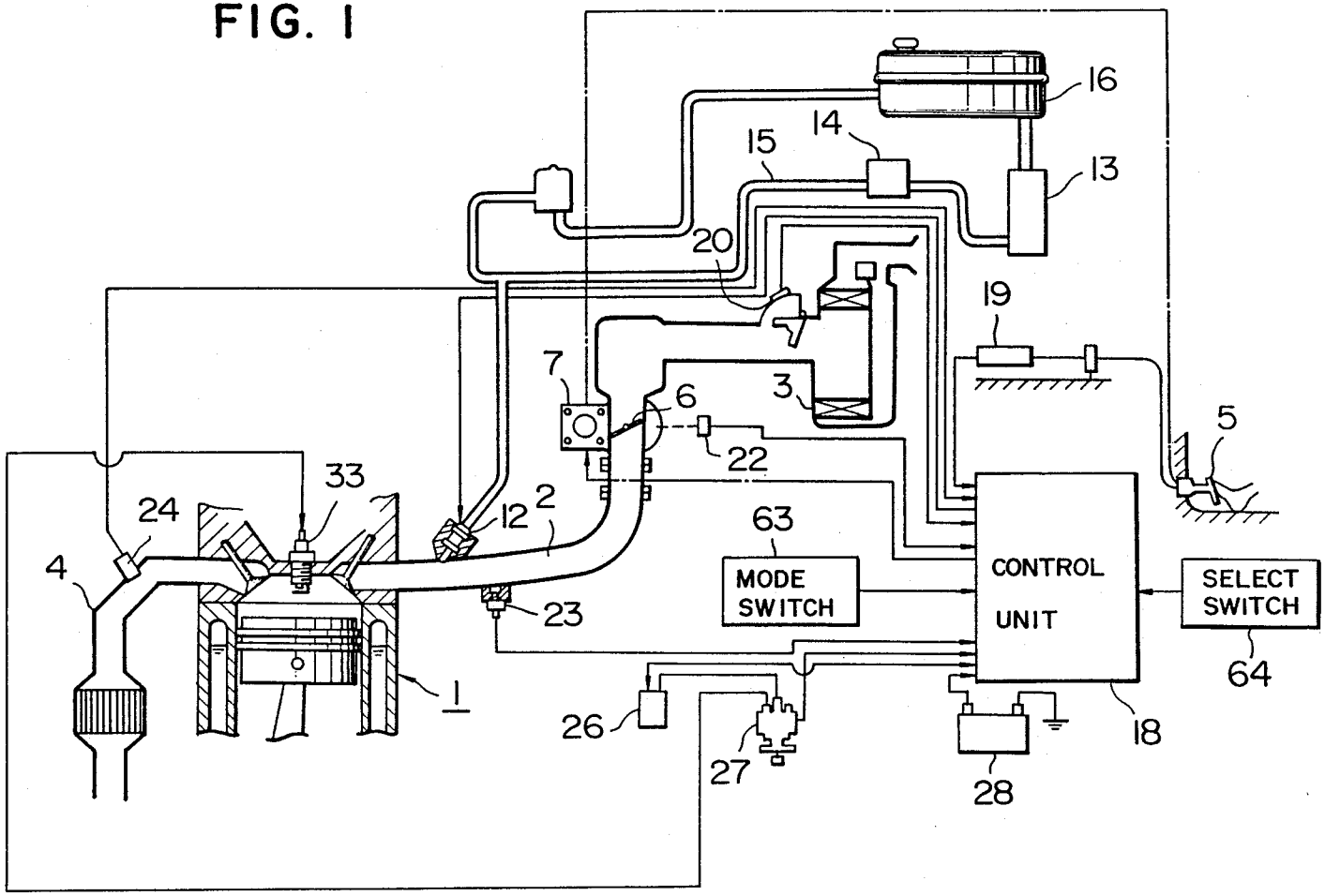
FIG. 1 is a schematic view of an engine output control system in accordance with the present invention.

Referring to the drawings, specifically to FIG. 1, there is shown a schematic view of an engine control system for an engine 1 of an automotive vehicle. The system is provided with an intake passage 2 connected with the engine 1 at one end and with an air cleaner 3 at the other end for introducing an intake air to the engine 1. There is also provided an exhaust passage 4 connected with the engine 1 for discharging an exhaust gas in the air.

In the intake passage 2 is disposed a throttle valve 6 for controlling an amount of the air introduced to the engine 1 in accordance with a stroke of an accelerator pedal 5 produced based on an operation of a driver. The throttle valve 6 is connected with a throttle actuator 7 for actuating the throttle valve 6 in response to the stroke of the accelerator pedal 5. A fuel injector 12 is arranged downstream of the throttle valve for injecting a fuel into the intake passage 2. A fuel supply system is provided a fuel pump 13, a filter 14 and a fuel tank 16 which are connected with the injector 12 through a fuel supply passage 15 for supplying the fuel to the injector 12.

There is provided a control unit 18 constituted by a micro computer for controlling the throttle actuator 7 and the fuel injector 12.

The control unit 18 receives signals from various sensors, such as an accelerator position sensor 19 for detecting a stroke of the accelerator pedal 5, an air flow meter disposed upstream of the throttle valve in the intake passage for measuring a quantity of the intake air, a throttle sensor 22 for detecting an opening of the throttle valve 6, a coolant thermometer 23 for detecting a temperature of a coolant for the engine 1, and an air-fuel ratio sensor 24 arranged in the exhaust passage 4 for detecting an air-fuel ratio of an intake gas.

There is provided an igniter 26 connected with a distributor 27 for igniting at a predetermined timing. Ignition signals from the igniter 26 are introduced into the control unit 18 for getting an engine speed. The distributor 27 is connected with the control unit 18 so that an ignition timing signal is introduced to the control unit 18. A battery 28 is connected with the control unit 18 for supplying a power. The control unit 18 detects a voltage of the battery 28. The ignition signal from the igniter 26 is introduced into an ignition plug 33 as a secondary voltage through the distributor 27.

Figure 2:
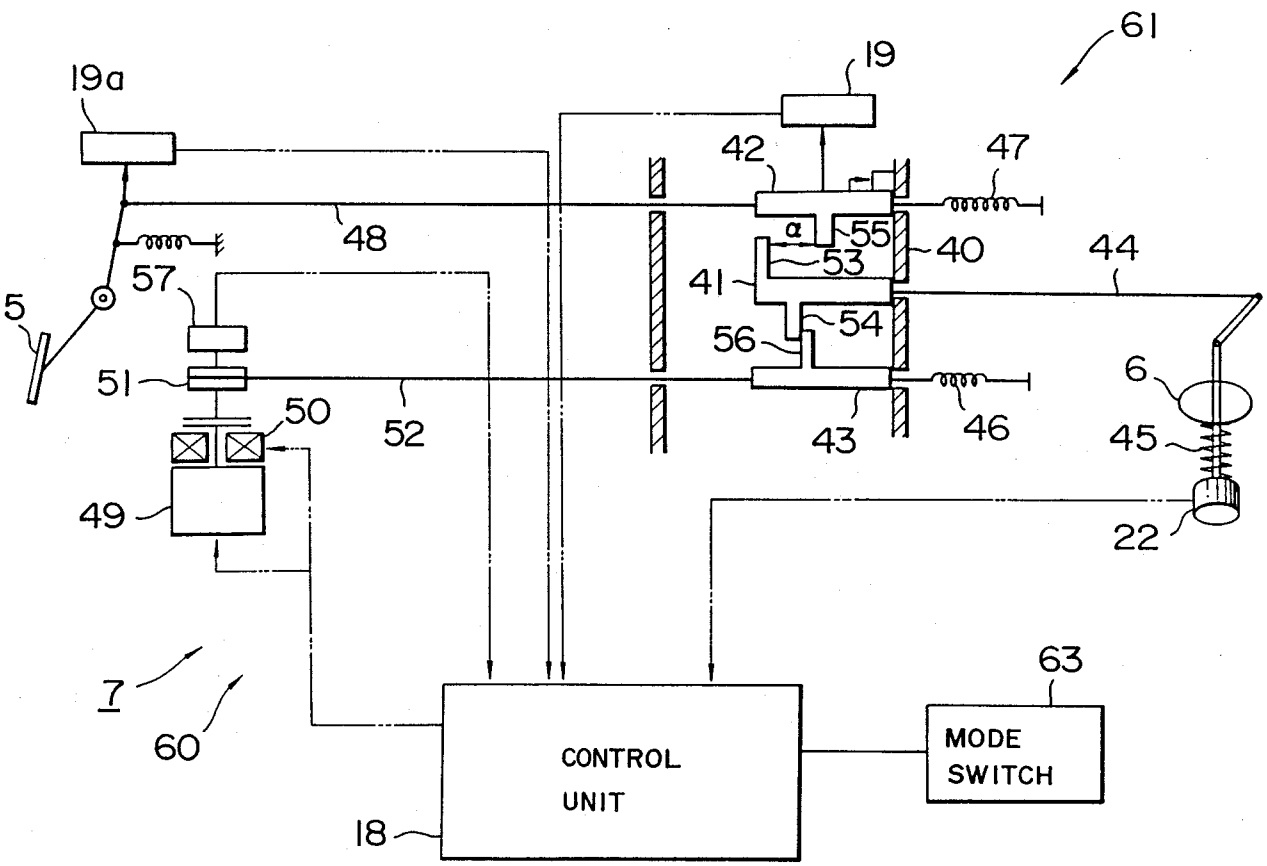
FIG. 2 is a simulative view of a throttle actuator applied to the engine output control system of FIG. 1.

Referring to FIG. 2, there is shown a simulative illustration of the throttle actuator 7.

The throttle actuator 7 is provided with a base plate 40. The throttle valve 6 is arranged at one side of the base plate 40. On the other side of the base plate are arranged a first, second and third segments 41, 42 and 43. The first segment 41 is connected with the throttle valve 6 by means of a wire 44 so that the first segment 41 opens the throttle valve 6 as the segment 41 goes away the base plate 40. The throttle valve 6 is provided with a spring 45 urging the valve 6 to a closed position so that the first segment 41 is urged toward the base plate 40. The second and third segments 42 and 43 are also urged toward the base plate 40 by springs 46 and 47. The second segment 42 is connected with the accelerator pedal 5 through a wire 48 so that the second segment 42 is moved apart from the base plate 40 as the stroke of the accelerator pedal 5 is increased. The stroke of the accelerator pedal 5 corresponds substantially to an amount of the movement of the second segment 42. Thus, the accelerator position sensor 19 is provided on the second segment 42. A back up accelerator position sensor 19*a* is mounted on the accelerator pedal 5.

The throttle actuator 7 is provided with a throttle motor 49 which can be constituted by a step motor. A rotation axis of the motor 49 is connected with a pulley 51 through a clutch 50. A wire 52 wound on the pulley 51 is connected with the third segment 43 at one end. The third segment 43 is moved away from and toward the base plate 40 as the throttle motor rotates in the case where the t clutch 50 is engaged.

The first segment 41 is provided with a projection 53 extending toward the second segment 42 at an end, which is apart from the base plate 40, for providing a mechanical control operation and a projection 54 extending toward the third segment 43 at a position closer to the base plate 40 than the projection 53 for providing an electrical control operation. The second segment 42 is formed with a projection 55 extending toward the first segment 41 at a middle portion with a distance $\alpha$ to the projection 53 of the first segment 41. The third segment 43 is provided with a projection 56 facing to the projection 54 of the first segment to be engaged with each other. Preferably, a throttle position sensor 57 is mounted on the pulley 51 for a servo control.

With this structure of the throttle actuator 7, the control unit 18, throttle motor 49, pulley 51, wire 52, third segment 43, first segment 41, wire 44 constitute an electrical control mechanism 60 for electrically controlling the throttle valve opening. On the other hand, the wire 48, second segment 42, first segment 41 and wire 44 constitute a mechanical control mechanism 61 for mechanically controlling the throttle valve opening. In other words, the illustrated throttle actuator 7 is provided with both the electrical and mechanical control mechanisms 60 and 61 for selectively controlling the opening of the throttle valve 6. The electrical control mechanism 60 is employed under an usual condition. The mechanical control mechanism 61 is employed under a specific condition such as an abnormal condition of the electrical control mechanism.

Operation of the Electrical Control Mechanism 60

The electrical control mechanism 60 is primarily provided for accomplishing a drive feeling control in which a controllability such as an acceleration, deceleration, controllability in an upland and the like is controlled to satisfy a driver's request, and an automatic speed control of the vehicle in which gear stages of a transmission and the throttle valve opening are controlled so that a vehicle speed is maintained at a predetermined constant value.

In the drive feeling control, a target throttle opening $T_{VOT}$ for providing an optimum engine output is set. The target throttle opening $T_{VOT}$ is determined based on a base throttle opening $T_{VOB}$ which is provided in accordance with basic operating conditions of the vehicle such as a gear position of the transmission, control mode indicated by a mode switch, stroke of the accelerator pedal and the like and additional operating conditions such as an operation speed of the accelerator pedal, vehicle speed, atmospheric pressure, coolant temperature and the like.

As shown in FIGS. 3A–3D, the control unit 18 is provided with a plurality of control properties for obtaining the base throttle opening $T_{VOB}$ corresponding to a power mode, economy mode, hold mode and releasing accelerator mode. A mode switch 63 connected to the control unit selects one of the control modes and produces signals corresponding to the respective control modes.

Figure 4A:
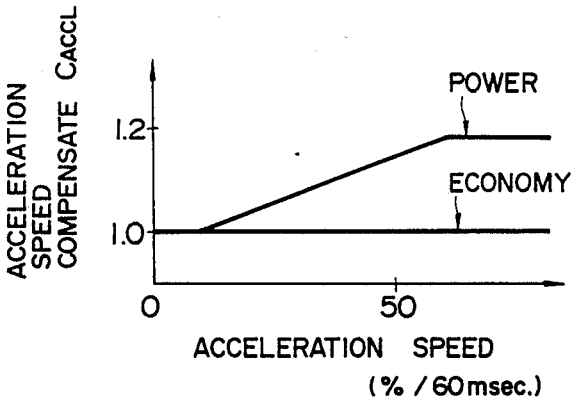
FIGS. 4A and 4B are graphical representations showing maps for providing compensating coefficients for the base throttle opening $T_{VOB}$.
Figure 4B:
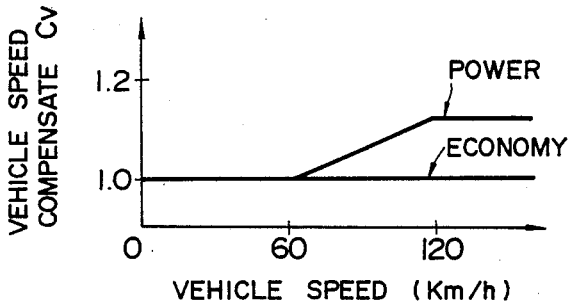

There is provided a select switch 64 for selecting one of gear stages such as a first stage range, second stage range, third stage range, neutral range, parking range and reverse range. Signals from the select switch denoting a gear stage currently selected are introduced into the control unit 18. The control unit 18 is provided with an acceleration compensating map for compensating the base throttle opening $T_{VOB}$ in accordance with the operation speed of the acceleration speed as shown in FIG. 4A and a vehicle speed compensating map for compensating the base throttle opening $T_{VOB}$ based on the vehicle speed as shown in FIG. 4B.

In the automatic speed control, the vehicle speed is maintained at a predetermined value set by the driver wherein a forth stage of the gear stages is generally not selected.

Operation of the Mechanical Control Mechanism 61

Figure 5:
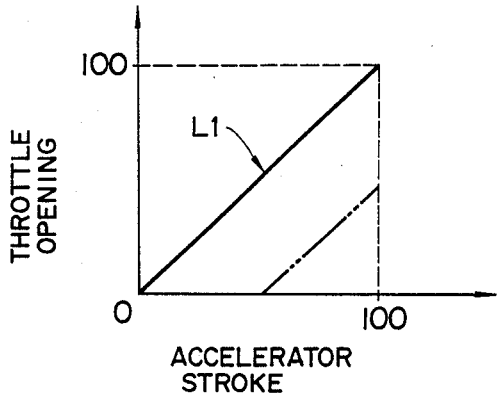
FIG. 5 is a graph exemplarily showing a relationship between a throttle opening and acceleration stroke under a mechanical and electrical control.

The mechanical control mechanism 61 is basically utilized so as to provide the throttle valve 6 with a minimum opening in the case where the electrical control mechanism is in an abnormal condition. When the accelerator pedal 5 is operated to increase the stroke, the projection 55 of the second segment 42 is moved by the distance $\alpha$ to contact with the projection 53 of the first segment 41. Thereafter, the movement of the second segment 42 causes the first segment to move away from the base plate 40 so that the throttle valve 6 is rotatably moved in accordance with a property shown in FIG. 5 by a phantom line wherein a property of the throttle opening based on the electrical control mechanism 60 shown by a real line L1 in FIG. 5 provides the throttle valve with a larger opening than the property of the phantom line with regard to the same stroke of the accelerator pedal 5.

Engine Output Control By Utilizing the Control Unit 18

Hereinafter, there is described a control for the throttle actuator 7 so as to control the engine output taking reference to FIG. 6 which shows a flow chart of a main program for the control.

The control unit 18 initializes a throttle control system to reset variables in the control system (S1). In step S2, the control unit 18 disengages the clutch 50 to carry out a throttle control utilizing the mechanical control mechanism 61. In next, the control unit 18 checks whether or not a voltage of the battery 28 is not less than 8 V which is considered to be sufficient for actuating the electrical control system 60 (S3). If the judgement in the step S3 is No, the throttle control is made by the mechanical control mechanism 61.

If the judgement is Yes in step S3, the control unit 18 judges whether or not the vehicle speed is more than 500 rpm (S4). When the vehicle speed is more than 500 rpm, the control system is in a stable condition so that the control unit 18 judges whether or not the control system is conditioned to be switched to a electrical control by means of the electrical control mechanism 60. In this procedure, the control unit 18 judges a value of a control flag S (S5) wherein values of S=1, 2 indicate that the throttle control is currently carried out by the mechanical control mechanism 61 and by the electrical control mechanism 60 respectively. If the judgment is No, this means that the throttle control is made by the electrical control system 60 in the precedent cycle. In this case, the control unit 18 connects the clutch 50 or maintains a connected condition thereof.

If the judgment is Yes, this means the throttle control is made by the mechanical control mechanism 61 in the precedent cycle. In this case, the control unit 18 judges the other conditions for avoiding a torque shock in switching operation from the mechanical control to the electrical control. In this procedure, the control unit 18 at first judges whether or not the select switch 64 is positioned at the parking range or the neutral range (S7).

Figure 7:
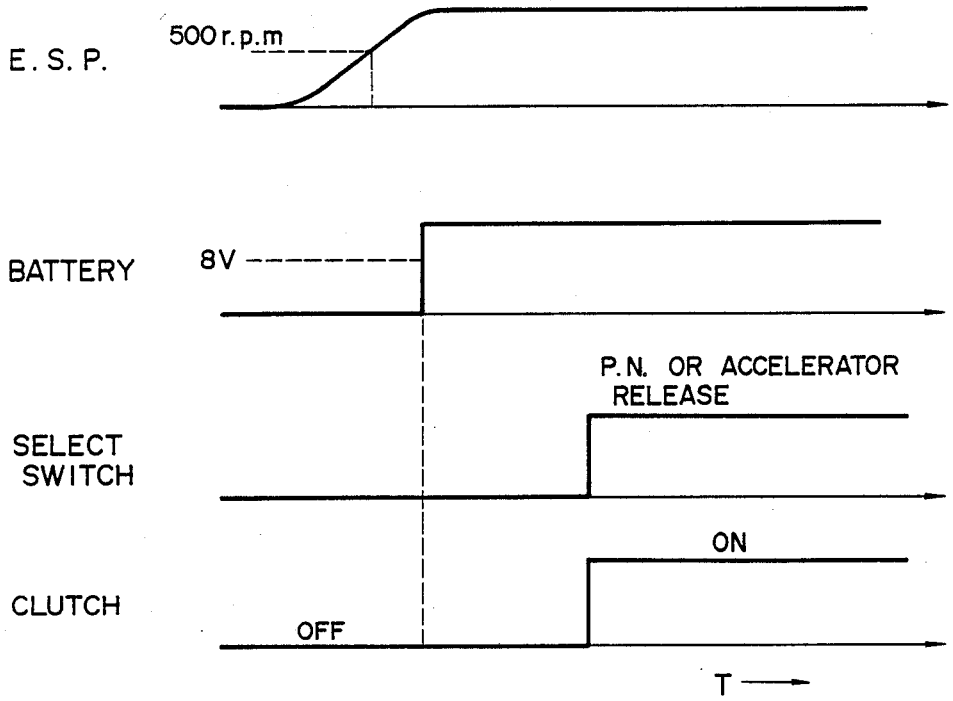
FIG. 7 is a time chart in the control of FIG. 6.

When this judgment is Yes, that is, when the select switch 64 is in the parking range or the neutral range, the throttle control is switched from the mechanical control to the electrical control (S6). If the judgment in step 7 is No, the control unit 18 makes a further judgment whether or not the accelerator pedal 5 is fully released (S8). When the judgment is Yes, namely when the accelerator pedal 5 is fully released, the control unit 18 engages the clutch 50 to switch the throttle control from the mechanical control to the electrical control, and set the value of the flag S=2 is step S9 because there is no risk to produce a big torque shock by the switching operation in step S6. Thus, when the engine speed is greater than 500 rpm, the battery voltage is greater than 8 V and the select switch is in the parking or neutral ranges or accelerator pedal is fully released, the clutch 50 is caused to be engaged as shown in FIG. 7.

In next, the control unit 18 judges whether or not the control system is conditioned for starting the automatic speed control (ASC) in step S10. If the judgment in step S10 is Yes, the control unit 18 carries out the automatic speed control in a manner that the throttle valve opening is controlled to as to maintain the vehicle speed at a predetermined constant value. If the judgment is No, the control unit 18 calculates the target throttle opening $T_{VOT}$ based on the maps as shown in FIGS. 3A–4B (S12).

Figure 6:
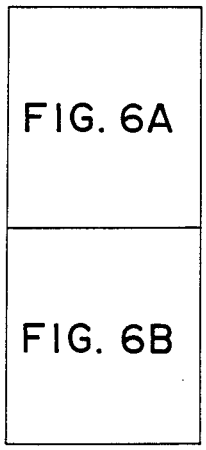
FIGS. 6, 6A, and 6B are flow charts showing a control for the throttle actuator.
Figure 6A:
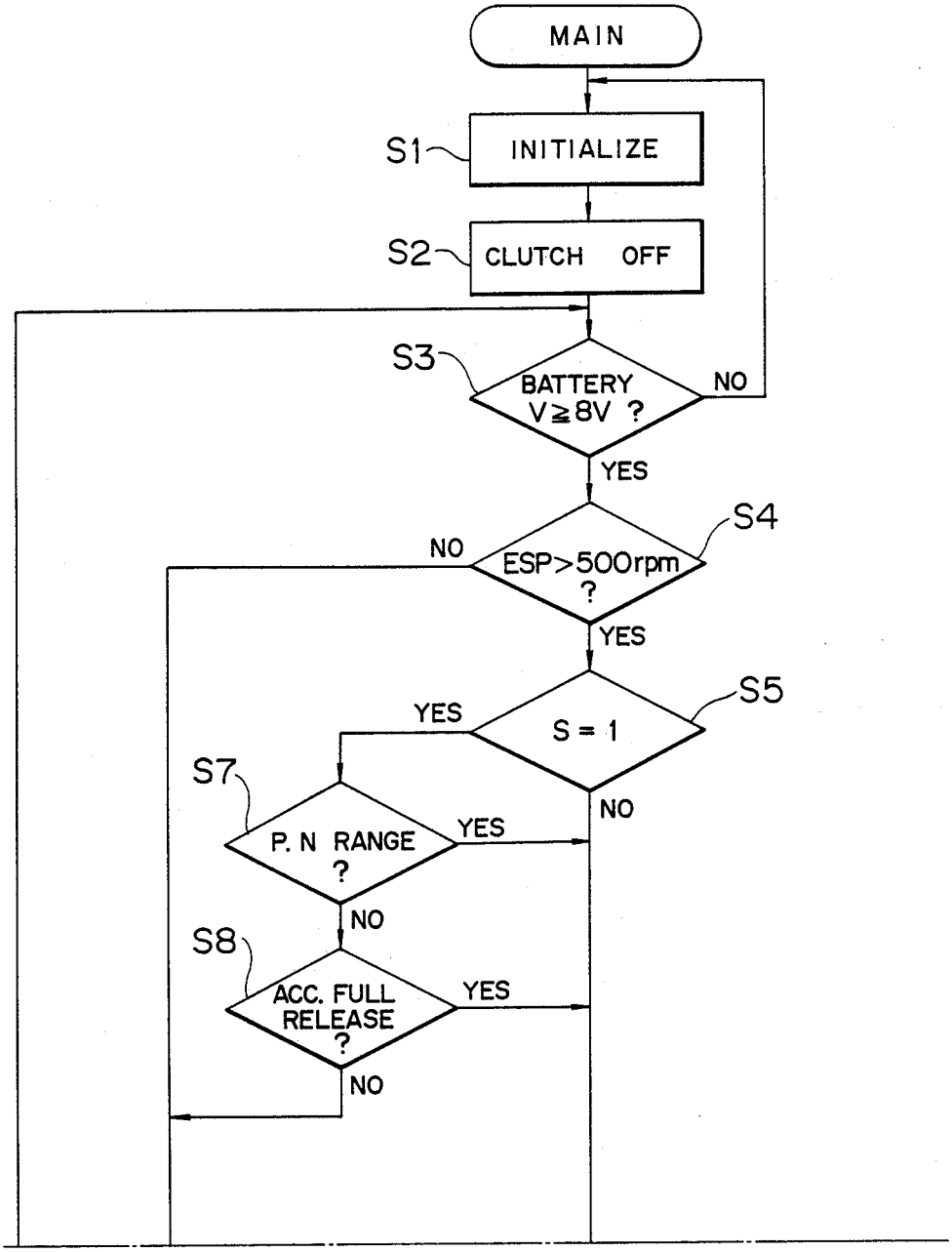
Figure 6B:
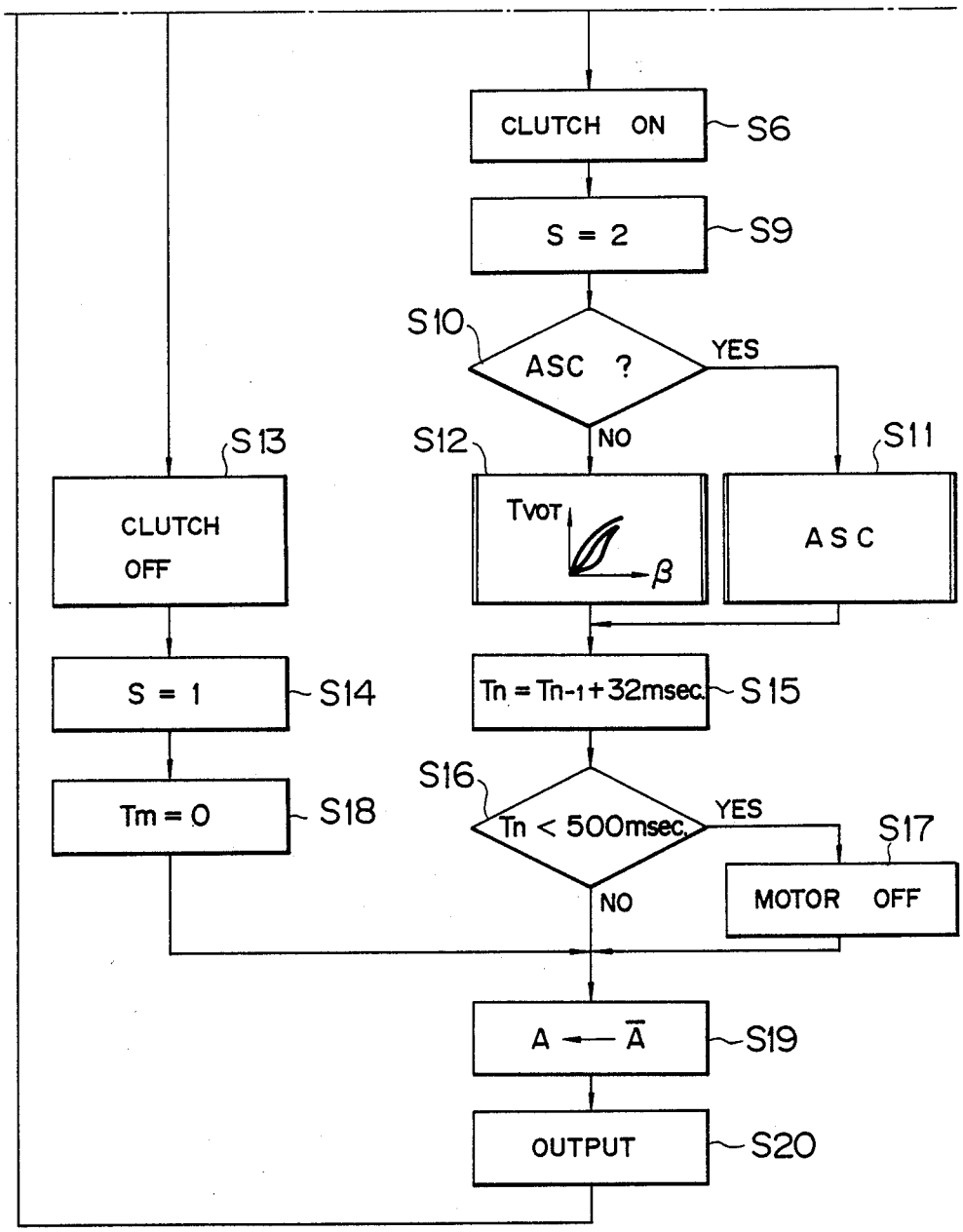
Figure 8:
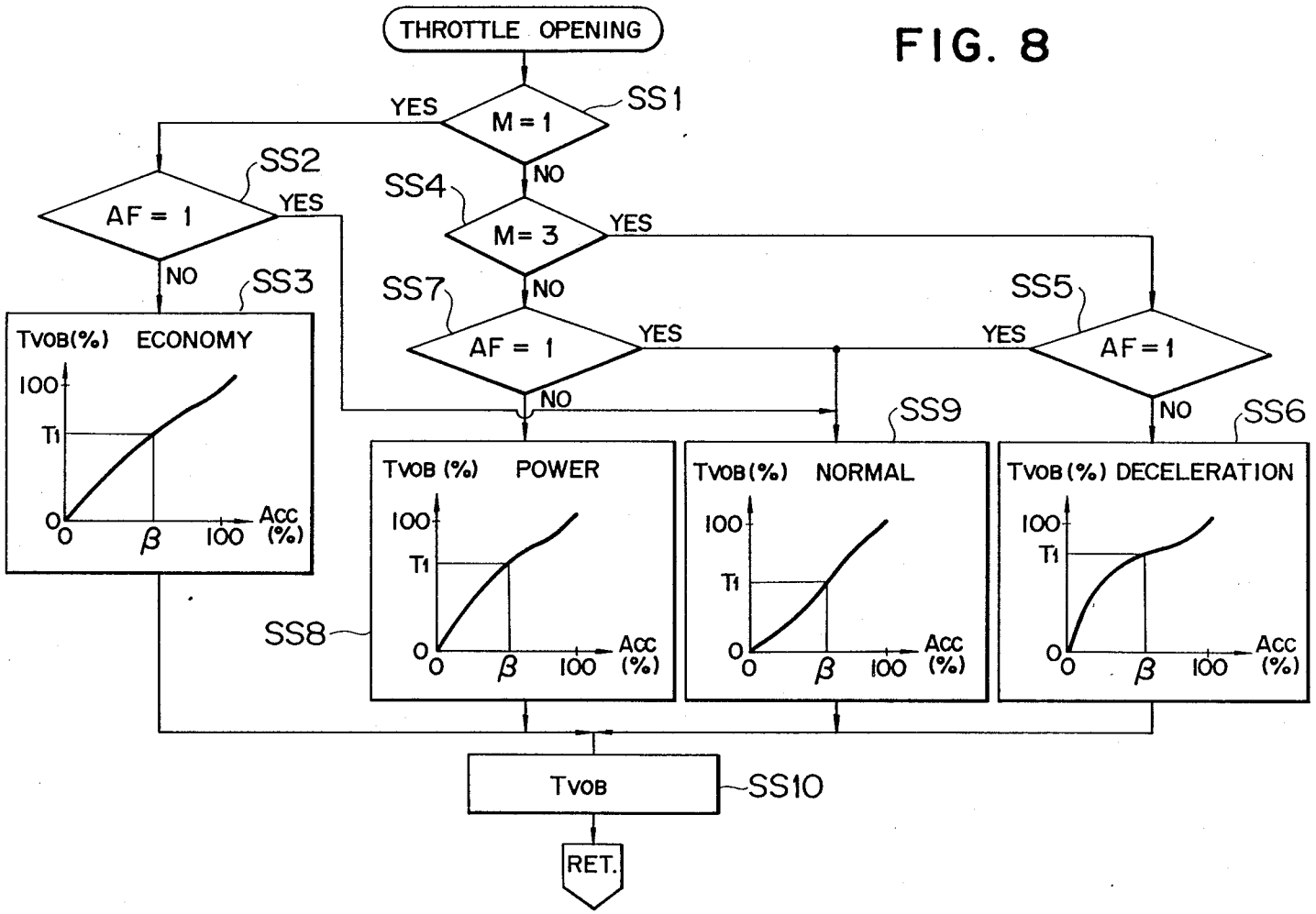
FIG. 8 is a flow chart for obtaining target throttle opening.

Now referring to the FIG. 8, there is shown a flow chart of a program for obtaining a optimum target throttle opening $T_{VOT}$ in step S12 of the flow chart in FIG. 6 in accordance with the engine operating condition.

In step SS1 of FIG. 8, the control unit 18 judges whether or not a value of a flag M which indicates a running mode of the vehicle is M=1 (economy mode). If the judgment is Yes, the control unit 18 further judges whether or not the stroke of the accelerator pedal is being reduced based a value of a flag AF wherein a value AF=1 indicates that the accelerator pedal is being reduced (SS2). If this judgment is No, that is, when the accelerator stroke is not being reduced, the control unit 18 select the map for the economy mode shown in FIG. 3B (SS3).

If the judgment in the step SS1 is No, the control unit 18 judges whether or not the mode switch flag M takes a value M=3 which denotes that vehicle is in a power mode condition (SS4).

Figure 3A:
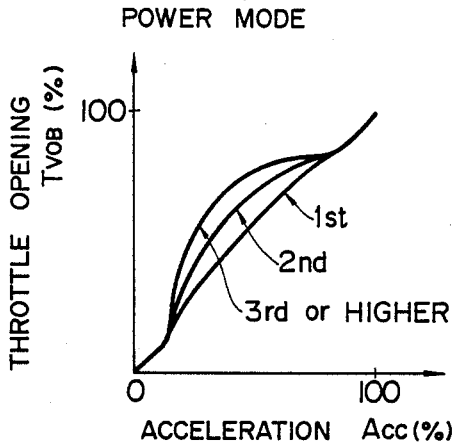
FIGS. 3A, 3B, 3C and 3D are graphical representations showing maps for different modes stored in a control unit for obtaining a base throttle opening $T_{VOB}$.
Figure 3B:
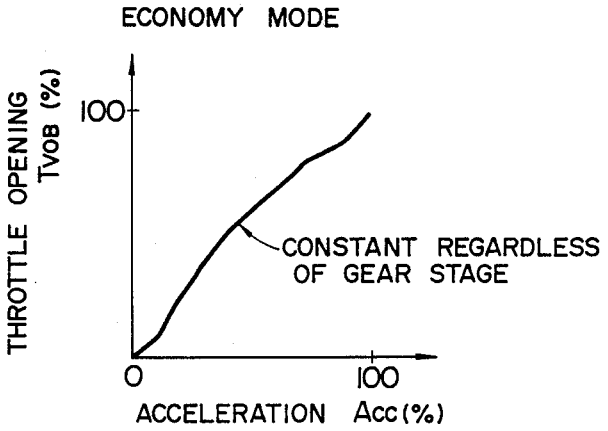

If the judgment in step SS4 is No, the control unit 18 further makes a judgment whether or not the flag AF is a value of AF=1 (SS5). If the value is not AF=1, the control unit 18 selects a map for the power mode condition as shown in FIG. 3A.

Figure 3C:
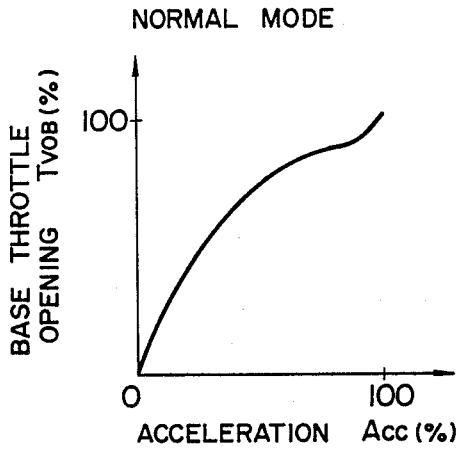

If the judgment in step SS4 is No, this means that the mode switch 63 is set at a normal mode. In this case, the control unit 18 judges whether or not the flag AF takes a value AF=1 as well (SS7). If this judgment is No, the control unit 18 selects the map for the normal mode condition as shown in FIG. 3C (SS8).

Figure 3D:
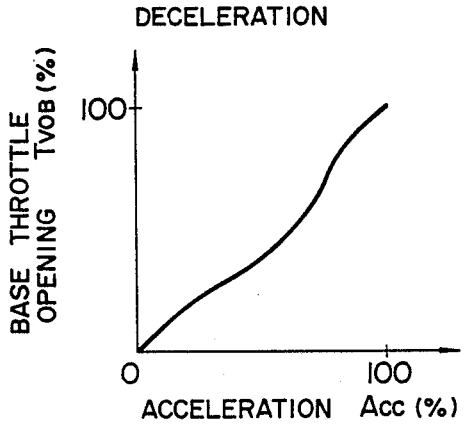

On the other hand, if either one of the judgments is Yes in Steps SS2, SS5 and SS7, that is, when the acceleration stroke is being reduced, the control unit 18 selects a map for deceleration as shown in FIG. 3D (SS9).

Then the control unit 18 obtains the base throttle opening $T_{VOB}$ corresponding to an accelerator stroke $\beta$ in view of the map selected in accordance with the above procedure (SS10). the base throttle opening $T_{VOB}$ is modified in accordance with the vehicle speed, acceleration speed and coolant temperature and the like to provide a target throttle opening $T_{VOT}$.

In step S4, the judgment is No, the engine is not conditioned for the electrical control so that the throttle control might become unstable. Therefore, the control unit 18 disengages the clutch 50 to separate the electrical control mechanism 60 and set the flag S=1. Consequently, the mechanical control mechanism 61 takes over the throttle control (S13, S14).

In the case where the throttle control is switched from the mechanical control to the electrical control, the control unit 18 restrains to energize the step motor 49 for 50 msec after the above judgment for switching from the mechanical control to the electrical control is made (S15, S16 and S17).

Figure 9:
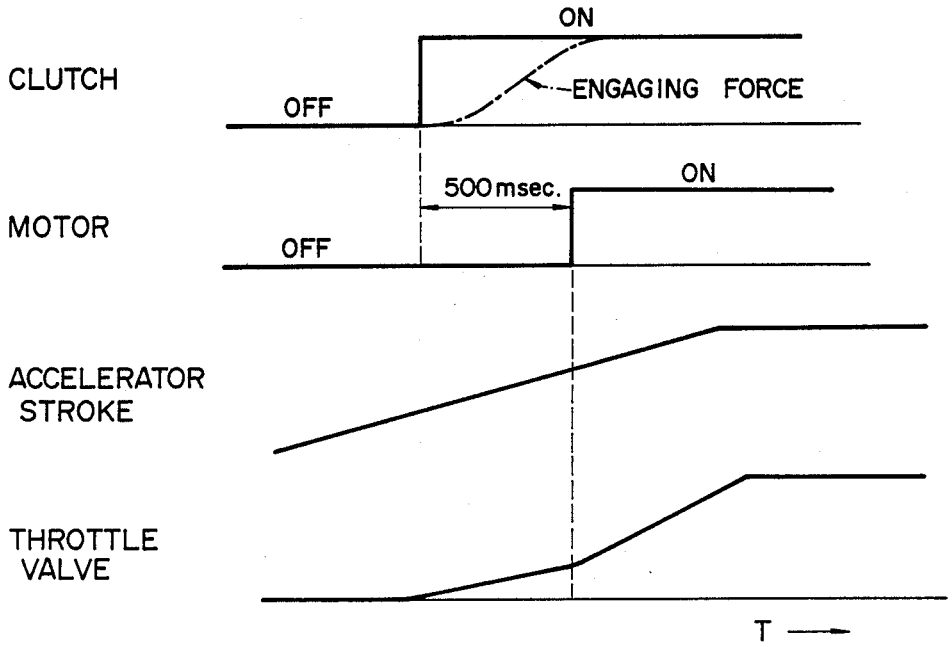
FIG. 9 is a time chart in the control of FIG. 6 as well as FIG. 7.

Thus, the clutch 50 is prevented from being subjected to unduly heavy load from the motor 49 before a sufficient engaging force is produced in the clutch 50 as shown in FIG. 9. Therefore, when the accelerator stroke is gradually increased, the throttle valve opening is continuously increased while the throttle control is switched from the mechanical control to the electrical control. As a result, a reliability of the throttle control can be improved and a wear of the clutch 50 can be considerably reduced.

Finally, the control unit 18 obtains a clock signal A by reversing a clock signal for a watchdog timer $\overline{A}$ and produces the signal to control the throttle actuator 7 (S19, S20).

Although the present invention has been described with reference to the specific embodiments, it is apparent from the disclosure to those skilled in the art that various changes, modifications can be made without departing from the spirits of the present invention. It is therefore to be understood that it is not intended to limit the invention to the specific embodiments.

We claim:

1. An engine output control system comprising an acceleration detecting means for detecting an amount of a stroke of acceleration means and producing an acceleration signal in accordance with the amount of the stroke of the acceleration means, output control means for controlling an engine output, electrical control means for determining an electrical control signal to actuate the output control means in accordance with the electrical control signal, mechanical control means mechanically linked with the output control means for actuating the output control means in accordance with the amount of the stroke of the acceleration means, abnormality detecting means for detecting an abnormality of the electrical control means, switch means for producing a signal to switch a control for the output control means between the mechanical control means and the electrical control means in a manner that the output control means is controlled by the mechanical control means when an abnormality is detected by the abnormality detecting means and is controlled by the electrical control means when any abnormality is not detected by the abnormality, and switching control means for performing an actual switching action from the mechanical control means to the electrical control means based on the signal from the switch means under a specific engine operating condition.

2. An engine output control system in accordance with claim 1 wherein the abnormality detecting means detects an abnormality of the electrical control means based on a voltage of a power supply applied for the electrical control means.

3. An engine output control system in accordance with claim 1 wherein the abnormality detecting means detects an abnormality of the electrical control means based on an engine speed.

4. An engine output control system in accordance with claim 1 wherein the output control means is constituted by throttle valve means arranged in an intake passage for controlling an amount of an intake air.

5. An engine output control system in accordance with claim 1 wherein the electrical control means is constituted by motor means for controlling the output control means, and the mechanical control means controls the output control means directly through wire means connected with the acceleration means.

6. An engine output control system in accordance with claim 1 wherein the specific engine operating condition is a condition under which the acceleration means is fully released, or gear position of a transmission is in a neutral range.

7. An engine output control system in accordance with claim 1 wherein the switching control means comprises clutch means provided between the output control means and the electrical control means, the specific engine operating condition being established in a predetermined period after the clutch is actuated to be engaged.

8. An engine output control system comprising output control means for controlling an engine output, acceleration means for producing a stroke in accordance with an amount of operation, a plurality of control properties showing respective relationships between the output control means and the acceleration means, property selecting means for selecting one of the control properties in accordance with an engine operating condition to determine a control gain for the output control means in response to the acceleration means, the property selecting means carrying out an actual selecting action of one of the control properties under a specific engine operating condition in which the engine output is not substantially affected.

9. An engine output control system in accordance with claim 8 wherein the specific engine operating condition is a condition when a value of the control gain in one of the control properties to be selected is substantially the same as a value of the control gain in another one of the control properties presently selected.

10. An engine output control system in accordance with claim 8 wherein the specific engine operating condition is a condition under which the acceleration means is fully released, or gear position of a transmission is in a neutral range.

11. An engine output control system comprising output control means for controlling an engine output, acceleration means for producing a stroke in accordance with an amount of an operation, electrical control means for controlling the engine output electrically, clutch means arranged between the electrical control means and the output control means for controlling a transmission of a control gain produced by the electrical control means to the output control means, mechanical control means for mechanically connecting the acceleration means with the output control means so as to control the engine output mechanically under a specific engine operating condition, gain control means for reducing the control gain for the output control means by a predetermined period after the mechanical control means is changed to the electrical control means.

12. An engine output control system in accordance with claim 1 wherein the electrical control means produces a signal substantially proportional to the stroke of the acceleration means, and the mechanical control means produces a signal smaller than the signal of the electrical control means for actuating the output control means.

13. An engine output control system in accordance with claim 9 wherein the specific engine operating condition is established in a predetermined period after the clutch is actuated to be engaged.

14. An engine output control system in accordance with claim 9 wherein the improvement further comprises abnormality detecting means for detecting an abnormality of the electrical means based on a voltage of a power supply applied for the electrical control means.

15. An engine output control system in accordance with claim 14 wherein the abnormality detecting means detects an abnormality of the electrical control means based on an engine speed.

16. An engine output control system in accordance with claim 9 wherein the output control means is constituted by throttle valve means arranged in an intake passage for controlling an amount of an intake air.

17. An engine output control system in accordance with claim 9 wherein the electrical control means is constituted by motor means for controlling the output control means, and the mechanical control means controls the output control means directly through wire means connected with the acceleration means.

* * * * *